US006684407B2

(12) United States Patent
Crooks St. Pierre

(10) Patent No.: US 6,684,407 B2
(45) Date of Patent: Feb. 3, 2004

(54) INFANT SLEEPER WITH STRETCHABLE SOCKS

(75) Inventor: Lorelei Crooks St. Pierre, Hawkesbury (CA)

(73) Assignee: St. Lawrence Textiles Inc., Hawkesbury (CA)

( * ) Notice: Subject to any disclaimer, the term of this patent is extended or adjusted under 35 U.S.C. 154(b) by 0 days.

(21) Appl. No.: 10/076,287

(22) Filed: Feb. 19, 2002

(65) Prior Publication Data

US 2003/0154535 A1 Aug. 21, 2003

(51) Int. Cl.[7] ..... A41D 11/00
(52) U.S. Cl. ..... 2/80; 2/83
(58) Field of Search ..... 2/83, 69, 80, 239–242, 2/75, 46

(56) References Cited

U.S. PATENT DOCUMENTS

| | | | | |
|---|---|---|---|---|
| 587,910 A | | 8/1897 | Arnold | |
| 1,623,753 A | * | 4/1927 | Rambo | 2/83 |
| 2,605,471 A | * | 8/1952 | Kephart | 2/83 |
| 2,636,287 A | | 4/1953 | Heibronner | |
| 2,705,804 A | * | 4/1955 | Walker | 2/83 |
| 2,725,567 A | * | 12/1955 | Bevier | 2/83 |
| 3,092,839 A | * | 6/1963 | Cantrell | 2/83 |
| 3,166,762 A | | 1/1965 | Winkworth | |
| 3,381,311 A | | 5/1968 | Wormser | |
| 3,653,074 A | * | 4/1972 | Nobile et al. | 2/80 |
| 5,058,208 A | | 10/1991 | Adams | |
| 5,153,940 A | | 10/1992 | Bergquist | |
| 6,247,183 B1 | | 6/2001 | Haas-Laursen | |

FOREIGN PATENT DOCUMENTS

| | | |
|---|---|---|
| JP | 10298806 | 11/1998 |

* cited by examiner

*Primary Examiner*—Tejash Patel
(74) *Attorney, Agent, or Firm*—Ogilvy Renault; Robert Mitchell

(57) ABSTRACT

A sleeper with an integral sock foot sewn directly to the sleeper instead of a traditional fabric constructed sock. The sock is made of stretchable material and is sized and shaped to contract into a snug and tight manner around the child's foot rather than loosely surrounding the foot, as it is the case with conventional footed sleeper.

7 Claims, 1 Drawing Sheet

INFANT SLEEPER WITH STRETCHABLE SOCKS

BACKGROUND OF THE INVENTION

1. Field of the Invention

The present invention relates generally to children's garments and, more particularly, to so-called infant sleepers.

2. Description of the Prior Art

Infant sleepers are well known and typically comprise a garment body having a pair of arm portions and a pair of leg portions for covering the child's body, arms and legs in a loosely fitting manner. The distal ends of the leg portions of known sleepers are usually provided with integral foot portions. Up to now the foot portion of conventional sleepers have been made from several pieces of fabric sewn together to form the approximate shape of the child's foot.

A major problem with such conventional footed sleepers is that in use, as when a baby is lying down and curled up in the fetal position or even when a baby is learning to crawl, the baby's feet do not stay within the "foot" area of the sleeper. This leads to discomfort for the baby. Furthermore, the baby's feet will not stay as warm as when the feet are properly encased inside the foot portions of the sleeper.

Another drawback of conventional footed sleepers is that the children cannot wear a shoe or boot comfortably with a sleeper on, thereby limiting the functionality of the garment to "sleepwear".

There is, thus, a need for a new sleeper foot construction which will overcome the above-mentioned drawbacks.

SUMMARY OF THE INVENTION

It is therefore an aim of the present invention to provide a footed sleeper adapted to prevent the child's feet from moving out of the foot portion of the sleeper and becoming drawn into or trapped in the leg portions of the sleeper.

It is also an aim of the present invention to provide a sleeper with an integral sock foot sewn directly to the sleeper instead of a traditional fabric constructed sock.

Therefore, in accordance with the present invention, there is provided a footed sleeper for a young child, comprising a garment body including a pair of leg portions adapted to loosely surround the child's legs, and a pair of form fitting knitted, stretchable socks attached by a seam to respective distal ends of said leg portions and being sized and shaped to cover the child's feet in a snug fit manner so as to prevent the child's feet from moving out of the socks and becoming drawn into in the leg portions of the footed sleeper.

In accordance with a further general aspect of the present invention, there is provided a footed sleeper for a young child, comprising a garment body made of a first fabric material to loosely cover the child's body, arms and legs, and a pair of socks made of a different material than that of said garment body, said socks being permanently attached to said garment body and being stretchable to provide a snug fit of the socks to the child's feet, thereby ensuring that said socks stay on the child's feet.

In accordance with a still further general aspect of the present invention, there is provided a footed sleeper for a young child, comprising a garment body having a pair of leg portions adapted to surround the child's legs in a loose fit manner, and a pair of stretchable socks permanently connected to said leg portions to provide a snug fit of the socks to the feet of the child.

This sock foot advantageously replaces the traditional foot, which is constructed out of several pieces of fabric and sewn together to form the approximate shape of the child's foot.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
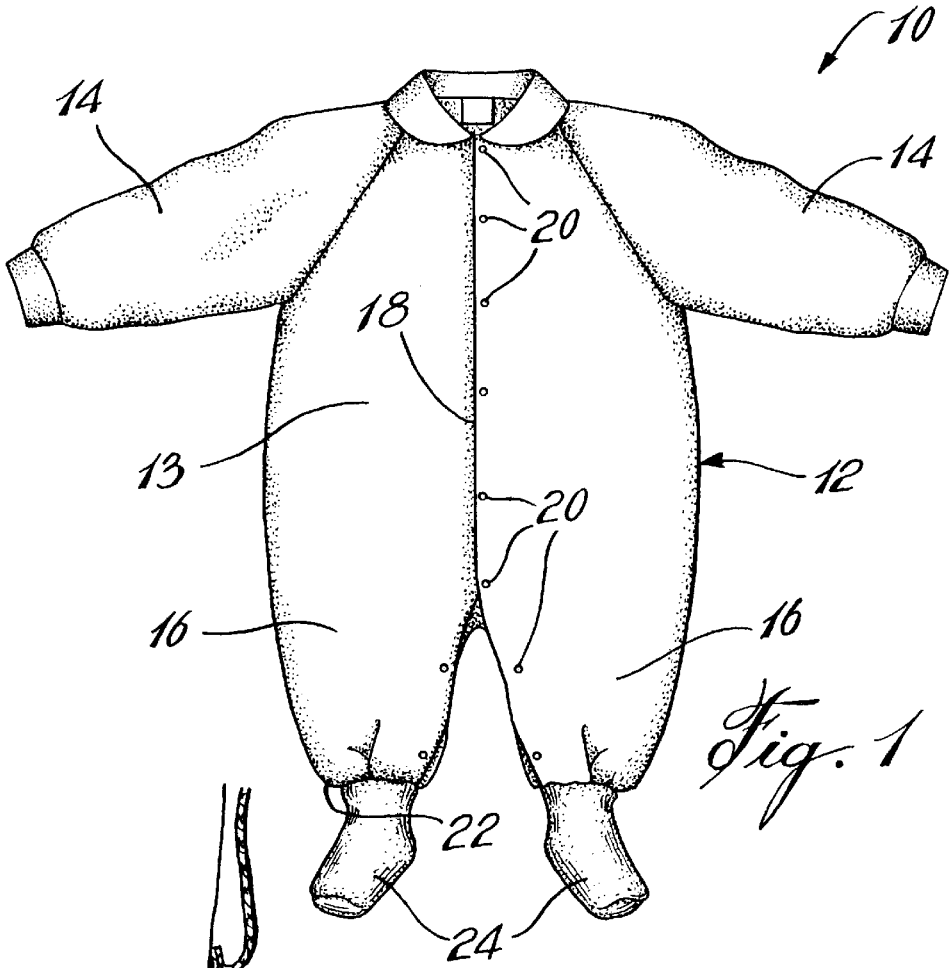
FIG. 1 is a front elevation view of a footed sleeper.

Now referring to the drawings, and in particular to FIG. 1, a footed sleeper 10 embodying the elements of the present invention will be described.

The footed sleeper 10 generally comprises a garment body 12 provided with a chest portion 13, a pair of arm portions 14 and a pair of leg portions 16 cooperating together to loosely cover the child's body, legs and arms. The garment body 12 is provided with a longitudinal opening 18 closable by a series of snap fasteners 20 or the like. The body 12 is preferably made of a relatively soft and porous fabric, which offers heat insulation, as well as breathability for the comfort of the child. The garment body 12 could, for instance, be made of cotton, polyester or acrylic textile material.

Figure 2:
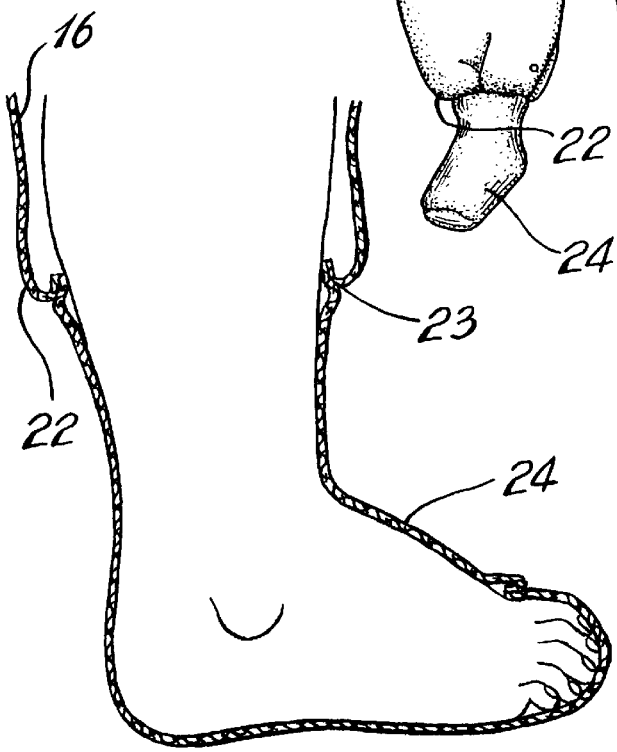
FIG. 2 is a cross-section of a foot portion of the footed sleeper of FIG. 1.

The leg portions 16 are integral to the chest portion 13 and terminate in tubular distal ends 22 sized to loosely surround the child's legs. Separately manufactured stretchable socks 24 are permanently connected to the distal ends 22, such as by stitching or the like. According to a preferred embodiment of the present invention, each sock 24 is provided in the form of a form fitting knitted, stretchy sock and is sewn directly to the distal end 22 of one of the leg portions 16. Each sock 24 is preferably connected to the associated leg portion 16 by a stretchable seam 23. It is important that each sock 24 fits exactly to the shape of the child's foot in a tight fit manner, as shown in FIG. 2. Indeed, the snug fit of the sock 24 on the child's foot advantageously keeps the child's foot within the foot area of the sleeper 10 when the child is lying down as well as when the child is learning to crawl. In this way, the child's feet are not prone to becoming drawn back or trapped in the loose leg portions 16 of the sleeper 10.

With the footed sleeper 10, the child's feet are closely wrapped with the stretchable fabric of the socks 24 and so helps to keep the child's feet warmer than the foot portions of a conventional footed sleeper, which is constructed out of pieces of fabric, sewn together.

Furthermore, with the sleeper 10, a shoe or boot can be worn comfortably over the sock.

The sleeper 10 has also the added benefit of protecting the child's leg from the cold; there is no space for air to enter into the leg portions 16, as the socks 24 are sewn directly to the leg portions 16 of the sleeper 10.

As set forth above, the footed sleeper 10 covers the child's foot with a real sock by attaching it to a real sleeper rather than covering the child's foot by constructing a foot shape out of fabric pieces sewn together. This is advantageous in that a shoe or boot can easily and comfortably be put over the sock of the sleeper 10. The footed sleeper 10 therefore has added functionality because it can be worn both as a sleeper (in the house, to sleep in) and as playwear outfit (out of the house) with shoes, booties or boots. The footed sleeper 10, with its added functionality, preserves the convenience and warmth of a one-piece sleeper. The sleeper 10 also looks different and neater than a traditional one-piece sleeper. The sleeper 10 is also advantageous because it allows the foot to grow in the sleeper as the sock foot stretches both widthwise and lengthwise, thereby allowing the baby to wear the sleeper 10 for longer as the baby grows. As mentioned hereinbefore, to make the foot portions of a sleeper out of a real sock rather than out of fabric ensures that the foot portions or socks of the sleeper 10 stay on the feet of the child while the child is learning to crawl.

What is claimed is:

1. A footed infant sleeper for a young child, comprising a garment body including a pair of leg portions adapted to loosely surround the child's legs, and a pair of foot hugging knitted, sretchable socks attached by a seam to respective distal ends of said leg portions and being sized and shaped to cover the child's feet in a snug fit manner so as to apply a compressive retention force on the feet of the child, thereby preventing the child's feet from moving out of the socks and becoming drawn into the leg portions of the footed sleeper while the child is wearing the footed sleeper, wherein each of said foot hugging knitted, stretchable socks is of a one-piece construction.

2. A footed sleeper as defined in claim 1, wherein said garment body and said socks are made of different materials, said garment being made of a relatively soft fabric.

3. A footed sleeper as defined in claim 2, wherein each said sock is sewn to a corresponding one of said leg portions along a stitched scam.

4. A footed infant sleeper for a young child, comprising a garment body made of a first fabric material to loosely cover the child's body, arms and legs, and a pair of socks made of a different material than that of said garment body, said socks being permanently attached to said garment body and being stretchable to provide a snug fit of the socks to the child's feet, thereby providing a compressive retention force opposing withdrawal of the feet from the socks, wherein each sock is of a one piece construction.

5. A footed sleeper as defined in claim 4, wherein said socks are sewn directly to said garment body.

6. A footed infant sleeper for a young child, comprising a garment body having a pair of leg portions adapted to surround the child's legs in a loosely fining manner, and a pair of stretchable socks permanently connected to said leg portions to apply a compressive retention force on the feet of the child to retain the feet against slipping out of the socks into the leg portions of the sleeper while the child is wearing the footed sleeper, wherein each of said stretchable socks is of a one piece construction.

7. A footed sleeper as defined in claim 6, wherein said socks are sewn to said leg portions along a stitched seam.

* * * * *